US008610595B1

(12) United States Patent
Aleteeby

(10) Patent No.: US 8,610,595 B1
(45) Date of Patent: Dec. 17, 2013

(54) VEHICLE U-TURN SAFETY ALERT SYSTEM

(76) Inventor: Salmaan F. F. M. S. Aleteeby, Sobah Alsalem (KW)

( * ) Notice: Subject to any disclaimer, the term of this patent is extended or adjusted under 35 U.S.C. 154(b) by 0 days.

(21) Appl. No.: 13/587,208

(22) Filed: Aug. 16, 2012

Related U.S. Application Data

(63) Continuation of application No. 13/553,557, filed on Jul. 19, 2012.

(51) Int. Cl.
*G08G 1/00* (2006.01)

(52) U.S. Cl.
USPC ..... 340/901; 340/903; 340/465; 340/466; 340/988; 340/435; 701/301; 342/107

(58) Field of Classification Search
USPC ..... 701/301, 93; 340/907, 475, 436, 425.5, 340/435, 901–903, 465, 466, 988, 9; 342/104, 107, 109; 382/181, 207
See application file for complete search history.

(56) References Cited

U.S. PATENT DOCUMENTS

| | | | | |
|---|---|---|---|---|
| 5,731,755 | A * | 3/1998 | Boxer | 340/465 |
| 7,409,294 | B2 * | 8/2008 | Mead et al. | 701/301 |
| 7,672,782 | B2 * | 3/2010 | Mead et al. | 701/301 |
| 2002/0062189 | A1 * | 5/2002 | Kannonji | 701/96 |
| 2003/0026009 | A1 * | 2/2003 | Vandenbrink | 359/841 |
| 2005/0090982 | A1 * | 4/2005 | Mead et al. | 701/301 |
| 2005/0156757 | A1 * | 7/2005 | Garner | 340/907 |
| 2005/0179533 | A1 * | 8/2005 | Stevenson | 340/475 |
| 2005/0187701 | A1 * | 8/2005 | Baney | 701/117 |
| 2005/0259033 | A1 * | 11/2005 | Levine | 345/7 |
| 2006/0181433 | A1 * | 8/2006 | Wolterman | 340/917 |
| 2006/0181449 | A1 * | 8/2006 | Aker | 342/104 |
| 2007/0132573 | A1 * | 6/2007 | Quach et al. | 340/475 |
| 2007/0276600 | A1 * | 11/2007 | King et al. | 701/301 |
| 2008/0174453 | A1 * | 7/2008 | Schofield | 340/933 |
| 2009/0002221 | A1 * | 1/2009 | Mead et al. | 342/113 |
| 2010/0117864 | A1 * | 5/2010 | Makukhin | 340/936 |
| 2010/0214126 | A1 * | 8/2010 | Publicover | 340/907 |
| 2011/0112720 | A1 * | 5/2011 | Keep et al. | 701/36 |
| 2011/0128136 | A1 * | 6/2011 | Katoh et al. | 340/435 |
| 2011/0298603 | A1 * | 12/2011 | King et al. | 340/436 |

OTHER PUBLICATIONS

Prior art cited in parent U.S. Appl. No. 13/553,557, filed Jul. 19, 2012, the priority of which is claimed herein.

* cited by examiner

*Primary Examiner* — Hoi Lau
(74) *Attorney, Agent, or Firm* — Richard C. Litman

(57) ABSTRACT

The vehicle U-turn safety alert system is a system for alerting a driver of a vehicle whether it is safe or unsafe to make a U-turn driving maneuver. The system incorporates an electronic system that measures the distance away and speed of an approaching vehicle. The system functions to calculate the time it would take for the approaching vehicle to reach the turning vehicle and displays this time as a digital readout. Visual and audible alerts inform the driver as to whether the U-turn maneuver can be safely accomplished.

6 Claims, 4 Drawing Sheets

VEHICLE U-TURN SAFETY ALERT SYSTEM

CROSS-REFERENCE TO RELATED APPLICATIONS

This is a continuation of my prior application Ser. No. 13/553,557, filed Jul. 19, 2012 now pending.

BACKGROUND OF THE INVENTION

1. Field of the Invention

The present invention generally relates to vehicle safety systems, and particularly to a vehicle U-turn safety alert system.

2. Description of the Related Art

The automotive industry is constantly adding innovations to promote vehicle safety and reduce driver stress and fatigue. Cruise control, lane departure alerts, automatic parallel parking, and rear view cameras are some of the systems that have been developed and incorporated in automotive vehicles to aid the driver and reduce costly, injurious and sometimes fatal accidents. The U-turn is one driving maneuver that is the cause of many vehicular accidents. The driver attempting the maneuver must often make a split-second judgment to determine the approximate speed of an approaching vehicle and whether the U-turn can be made in time to avoid a collision with the approaching vehicle. There have been several attempts, disclosed in the related art, drawn to devices for managing control of a turning vehicle. However, none of the related art devices are programmed to determine distance and velocity parameters of approaching vehicles to establish whether a U-turn maneuver can be safely made. Thus, a vehicle U-turn safety alert system solving the aforementioned problems is desired.

SUMMARY OF THE INVENTION

The vehicle U-turn safety alert system is a system for alerting a driver of a vehicle whether it is safe or unsafe to make a U-turn driving maneuver. The system incorporates an electronic system that measures the distance to and speed of an approaching vehicle. The system functions to calculate the time it would take for the approaching vehicle to reach the turning vehicle and displays this time as a digital readout. Visual and audible alerts inform the driver as to whether the U-turn maneuver can be safely accomplished. The system includes optical sensors, at least one universal serial port (USB), and warning indicators, such as a buzzer and light emitting diodes (LEDs).

Accordingly, the invention presents a system for preventing collisions that may occur when attempting a U-turn driving maneuver. The system is adapted for installation on almost any motorized vehicle (autos, trucks, motorcycles, etc.). The system may also be installed as part of the highway or road structure. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
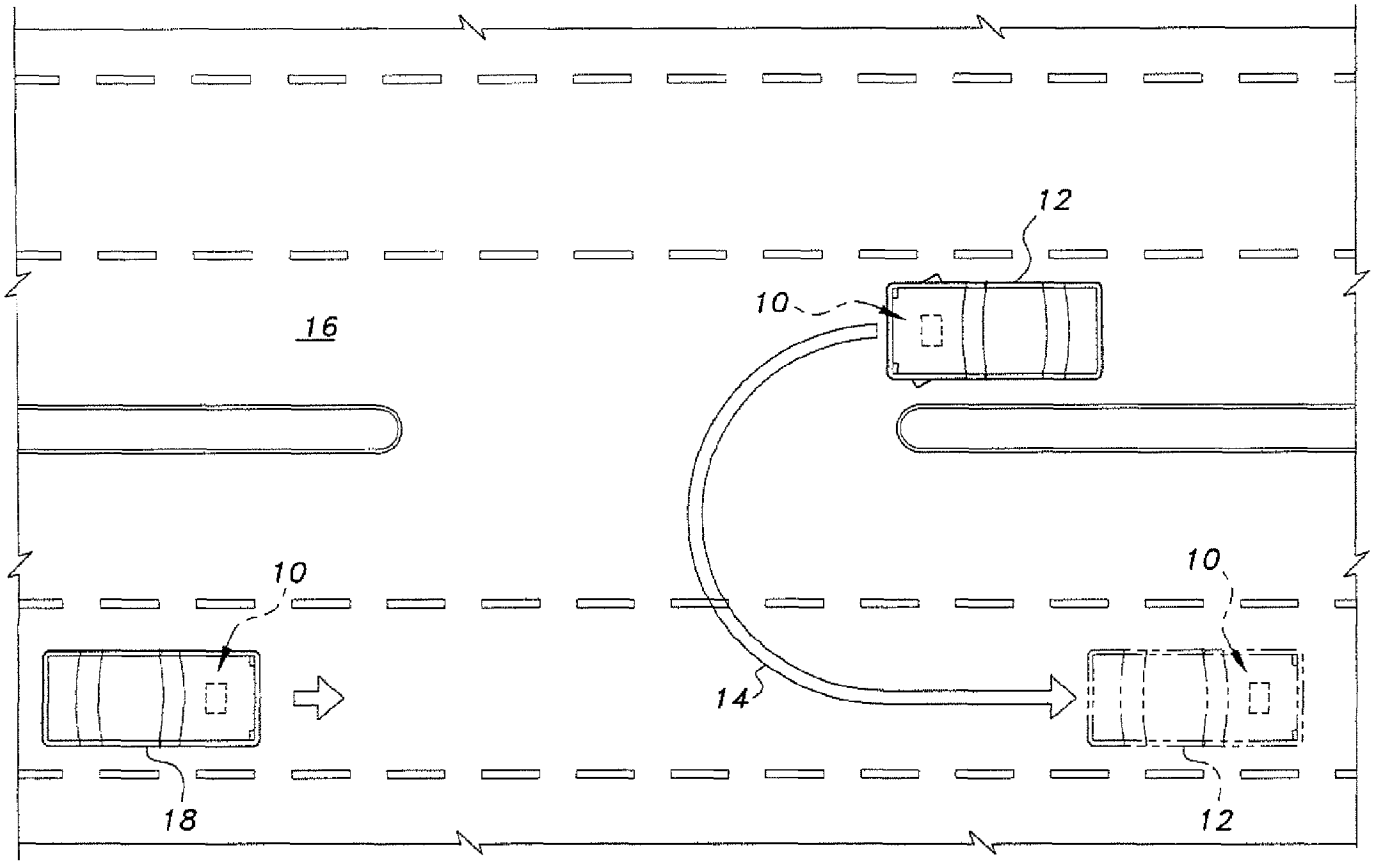
FIG. 1 is a schematic view of a vehicle about to make a U-turn maneuver.

FIG. 1 schematically illustrates a first vehicle 12 making a U-turn maneuver 14 on a roadway 16. A second vehicle 18 approaches the first vehicle 12 as the U-turn maneuver is being executed. Each vehicle is provided with a vehicle U-turn safety alert system 10 (shown in phantom lines), as described more fully below.

Figure 2:
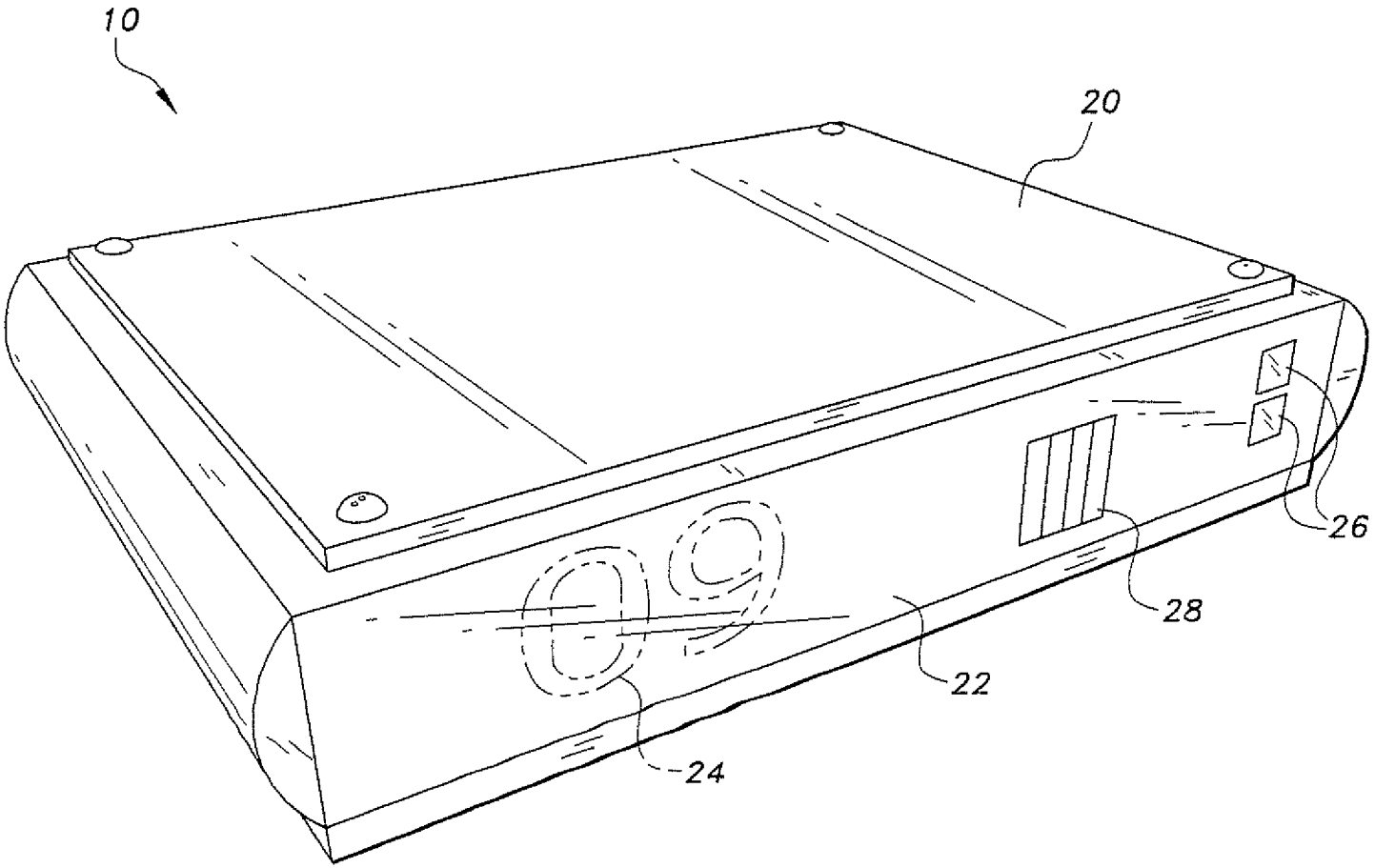
FIG. 2 is a perspective view of a display module of a vehicle U-turn safety alert system according to the present invention.
Figure 3:
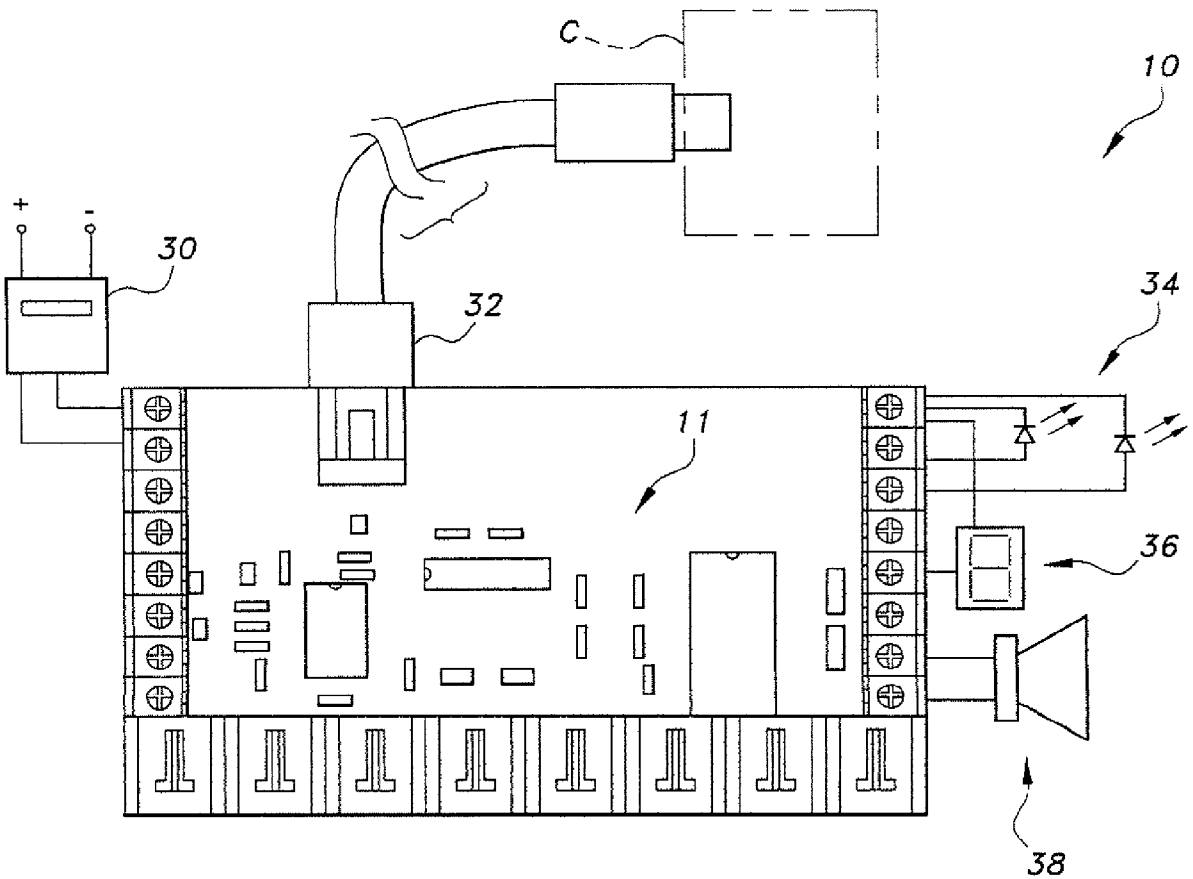
FIG. 3 is a diagrammatic top view of the display module FIG. 2, showing the internal component layout and partial schematics of selected electronic circuitry utilized in the module.

Referring to FIGS. 2 and 3, the vehicle U-turn safety alert system includes a display module housing electronic circuitry for the U-turn safety alert system 10, generally indicated at 11. The display module includes a casing 20 provided with a front panel 22 that incorporates a digital readout at 24, green and red LED alerts 26 and a warning buzzer 28. The circuitry 11 includes sensors, analog inputs, an interface and all conventional electronic parts in an arrangement to gather the data necessary to predict the time it would take to perform a safe U-turn maneuver. The electronic circuitry also includes a 9-volt electronic transformer 30 that is connected to the battery system of the vehicle. The display module electrical system includes a USB port 32 that is connectable with a computer C (shown in phantom lines). Circuits 34, 36, and 38 are provided to respectively activate red and green warning lights, the digital readout and the warning buzzer.

In use, when a U-turn maneuver is about to be made, the sensors of the electronic circuitry 11 provide data related to the speed of an approaching vehicle 18 and the distance between the vehicle 12 about to make the U-turn and the approaching vehicle 18. The sensed data is fed to the computer C, which includes software that translates the data to estimate a first time needed to accomplish the U-turn maneuver and compares this first time with a second time that estimates when the approaching vehicle will arrive at the point of the U-turn. This second time will be displayed on the digital readout 24. If the system determines that the difference between the first time and the second time is sufficient to accomplish the U-turn maneuver without collision, the system will function to activate the green LED. If the time is considered to be insufficient to avoid collision, the red LED and the warning buzzer will be activated.

Figure 4:
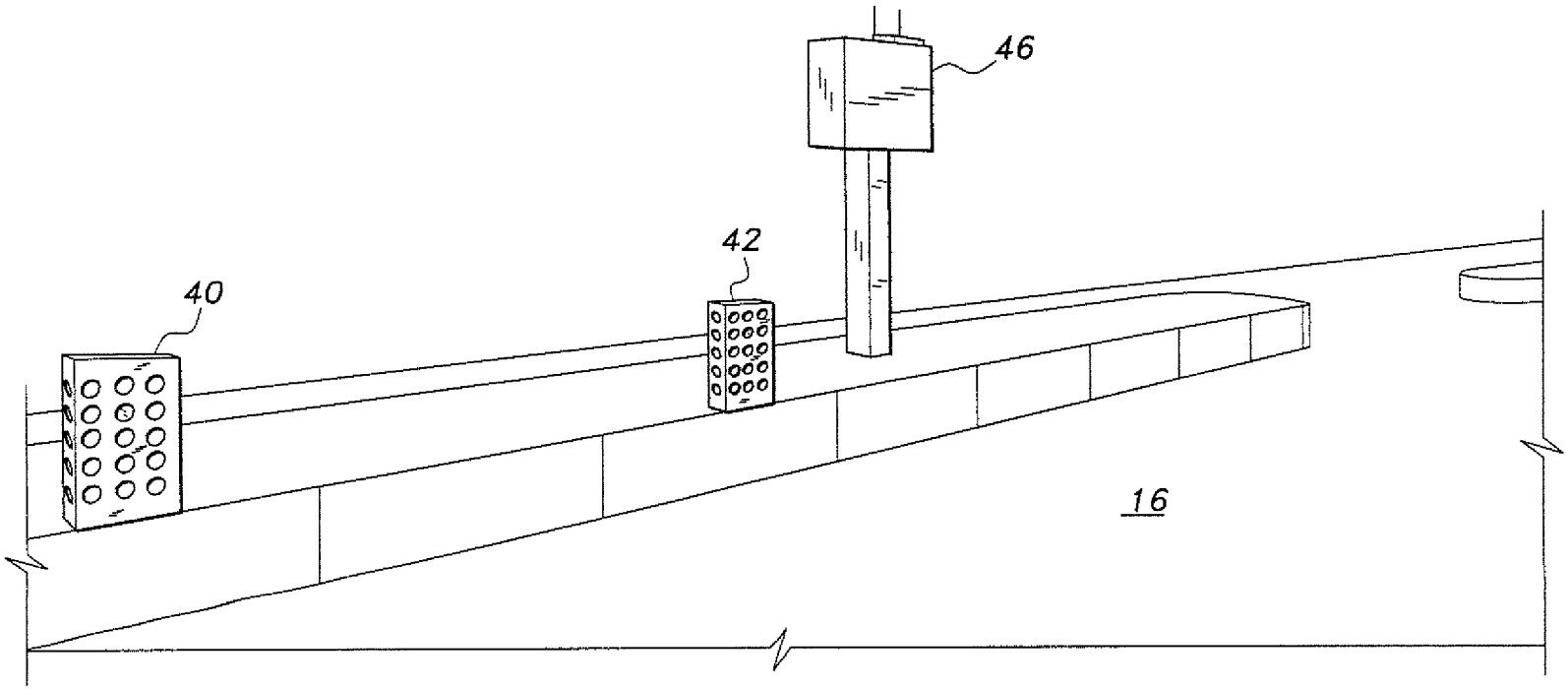
FIG. 4 is a perspective view showing a vehicle U-turn safety alert system according to the present invention adapted for mounting on a road or highway.

An alternative embodiment of the system is illustrated in FIG. 4, wherein sensors 40 and 42 are mounted beside the roadway 16 at an area where frequent U-turns occur. The sensors respectively collect data generated by the vehicle attempting to make a U-turn and the approaching vehicle. The data is transmitted to a control box 46, which is mounted on the highway adjacent to the sensors. A signal generated from the control box is transmitted to the system 10 in the vehicle that is attempting to make the U-turn. The system 10 will function as described above to indicate if the U-turn maneuver can be safely accomplished.

It is to be understood that the present invention is not limited to the embodiments described above, but encompasses any and all embodiments within the scope of the following claims.

I claim:

1. A U-turn safety alert system comprising:

first position and speed sensor determining the time it would take for a first vehicle to perform a U-turn maneuver disposed along roadway;

second position and speed sensor determining time it would take for an approaching second vehicle to collide with the first vehicle performing the U-turn maneuver disposed along roadway;

a display device disposed in the first vehicle for displaying the second vehicle's approach time;

a computer for comparing the estimated time of the first vehicle and the displayed approach time of the second vehicle; and a signal generator for alerting a driver of the first vehicle if the second vehicle's approach time is insufficient to safely accomplish the U-turn maneuver to avoid collision with the second vehicle.

2. The U-turn safety alert system according to claim 1, wherein said display device includes at least a digital readout display.

3. The U-turn safety alert system according to claim 1, wherein said signal generator includes an LED array.

4. The U-turn safety alert system according to claim 1, wherein said signal generator includes a buzzer.

5. The U-turn safety alert system according to claim 1, wherein said signal generator includes an array of LEDs and an audible buzzer; said array of LEDs includes at least two colors for selectively indicating safe and not safe U-turn conditions; said audible buzzer for indicating not safe U-turn conditions.

6. The U-turn safety alert system according to claim 5, further comprising a control box disposed along roadway for transmitting a signal to said first vehicle the safe and not safe U-turn conditions.

* * * * *